US007677576B2

(12) United States Patent
Sandoval et al.

(10) Patent No.: US 7,677,576 B2
(45) Date of Patent: Mar. 16, 2010

(54) ELECTRONIC LAST-TO-ANSWER TIMED RESPONSE GAME

(75) Inventors: Julio Sandoval, Wilmington, CA (US); George T. Foster, Placerville, CA (US)

(73) Assignee: Elliott A. Rudell, Torrance, CA (US)

( * ) Notice: Subject to any disclaimer, the term of this patent is extended or adjusted under 35 U.S.C. 154(b) by 0 days.

(21) Appl. No.: 11/452,470

(22) Filed: Jun. 13, 2006

(65) Prior Publication Data

US 2007/0284826 A1 Dec. 13, 2007

(51) Int. Cl.
*A63F 9/18* (2006.01)

(52) U.S. Cl. ..... 273/429; 273/432

(58) Field of Classification Search ..... 273/429–432; 434/322, 323, 335, 336–341, 344, 346, 350–352, 434/362

See application file for complete search history.

(56) References Cited

U.S. PATENT DOCUMENTS 4,300,763 A * 11/1981 Barr ..... 273/460
4,767,335 A * 8/1988 Curt ..... 434/352
4,772,027 A * 9/1988 Martel et al. ..... 273/237
4,895,364 A * 1/1990 Martel et al. ..... 273/237
5,092,779 A * 3/1992 Piwonka et al. ..... 434/352
5,219,433 A * 6/1993 Zaruba et al. ..... 273/432
5,364,108 A * 11/1994 Esnouf ..... 463/9
5,421,590 A * 6/1995 Robbins ..... 463/37
5,724,357 A * 3/1998 Derks ..... 370/313
6,657,550 B1 * 12/2003 Flinn ..... 340/825.72
2005/0170873 A1 * 8/2005 Fishbach et al. ..... 463/9

OTHER PUBLICATIONS

Last Word, comments on play of game found at website http://www.funagain.com/control/product/~product_id=015400, 2007.*
Buffalo Games, Inc., Last Word, Random Games & Toys, 2005, Buffalo, New York.
Are You Game.com, Taboo Game by Hasbro.
The Original San Franciso Toymakers in Your Face Game, Vivid Imaginations, mail order Express.com.
Games by James, Catch Phrase, Electronic, gamesbyjames.biz.

* cited by examiner

*Primary Examiner*—William M Pierce
(74) *Attorney, Agent, or Firm*—Ben J. Yorks; Irell & Manella LLP

(57) ABSTRACT

An electronic game that awards the last player to correctly answer a question before the expiration of a timer. The game includes a plurality of buttons and corresponding indicators coupled to a housing. Within the housing is a controller that causes a question to be displayed on a screen. A timer also counts to a time interval. The controller activates an indicator associated with a button that was depressed last by a player that provides a correct answer to the question at the expiration of a timer. The last player can then move a token on a board. The player that moves their token to the end of the board wins the game.

22 Claims, 5 Drawing Sheets

ELECTRONIC LAST-TO-ANSWER TIMED RESPONSE GAME

BACKGROUND OF THE INVENTION

1. Field of the Invention

The present invention relates to an electronic game.

2. Prior Art

There have been marketed various electronic games that include questions and answers. For example, there has been marketed under the trademark IN YOUR FACE that displays questions and squirts a player with water if they do not answer the question correctly. Questions for players to answer are displayed on an LCD screen. This product is covered by U.S. Pat. Nos. 5,222,660 and 5,992,853.

Hasbro Games markets a game under the name CATCH PHRASE wherein a player would have to provide phrases before an electronic timer elapsed. Hasbro also markets a game under the name TABOO that included an electronic horn that sounded off when a player provided an inaccurate answer to a question.

Buffalo Games, Inc. of Buffalo, N.Y., has markets a game call LAST WORD. LAST WORD includes a deck of cards that each have a subject such as "vegetable" or "breed of dog". The players have to provide relevant responses such as carrot for vegetable, or terrier for breed of dog. The person who provides the last correct response before the expiration of a timer gets to move a token on a board. The player who moves their token to the end of the board wins the game.

BRIEF SUMMARY OF THE INVENTION

An electronic game that includes a plurality of buttons and corresponding indicators coupled to a housing. The game includes a controller that causes a question to be displayed on a screen. A timer also counts to a time interval. The controller activates an indicator associated with a button that was depressed last by a player that provides a correct answer to the question before the expiration of the timer.

DETAILED DESCRIPTION

Disclosed is an electronic game that awards the last player to correctly answer a question before the expiration of a timer. The game includes a plurality of buttons and corresponding indicators coupled to a housing. Within the housing is a controller that causes a question to be displayed on a screen. A timer also counts to a time interval. The controller activates an indicator associated with a button that was depressed last by a player that provides a correct answer to the question at the expiration of the timer. The last player can then move a token on a board. The player that moves their token to the end of the board wins the game.

Figure 1:
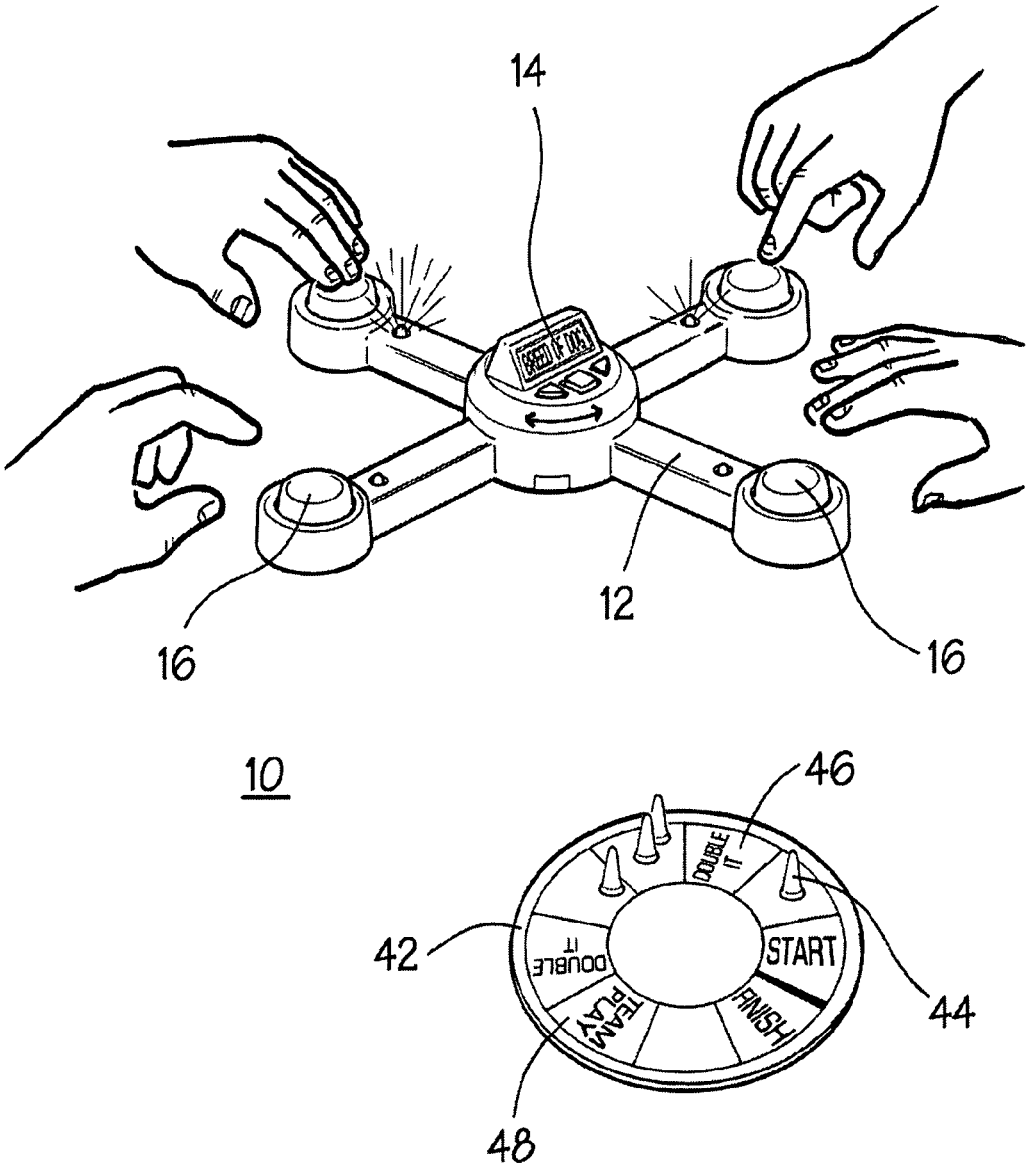
FIG. 1 is an illustration of an electronic game.
Figure 2:
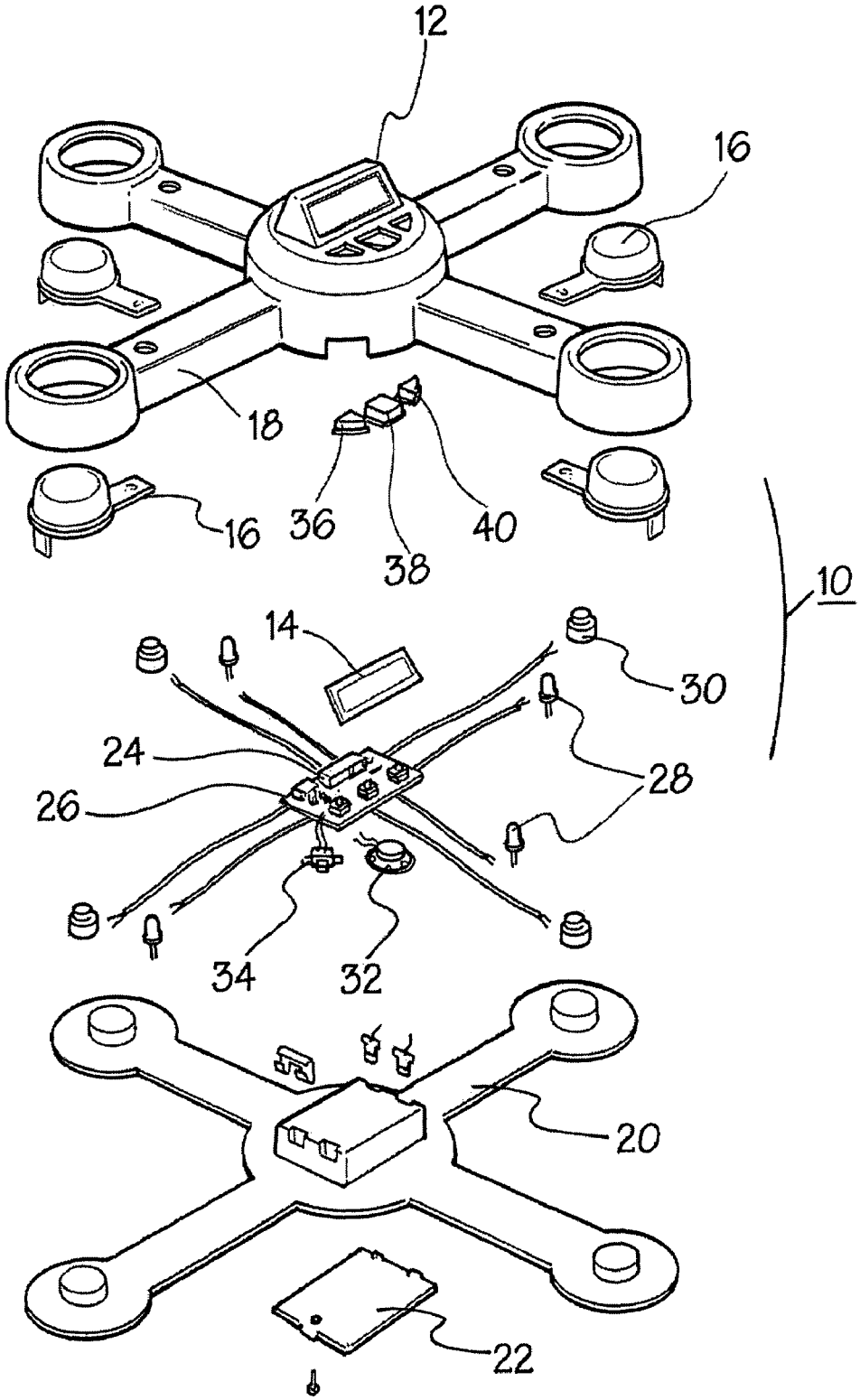
FIG. 2 is an illustration of an exploded view of the electronic game.

Referring to the drawings more particularly by reference numbers, FIGS. 1 and 2 show an embodiment of an electronic game 10. The game 10 includes a housing 12 that supports a screen 14 and a plurality of buttons 16. The screen 14 may be pivotally connected to the housing 12 as indicated by the arrows. The housing 12 may include a top component 18, a bottom component 20 and a battery lid 22 that are constructed from a lightweight and inexpensive plastic material such a polystyrene or equivalent. The buttons 16 may also be constructed from a similar plastic material.

The housing 12 may enclose a controller 24 located on a printed circuit board assembly 26. The controller 24 is coupled to the screen 14 and a plurality of indicators 28. There may be an indicator 28 associated with each button 16. The indicators 28 may be light sources that can be illuminated by the controller 24.

Each button 16 may include a switch 30 that is connected to the controller 24. The game 10 may further have a speaker 32, an ON/OFF switch 34 and an array of PLAY buttons 36, 38 and 40.

The game 10 may include a board 42 and various tokens 44. Although a board 42 is shown and described, it is to be understood that there may be other ways to score or otherwise reward a player of the game, such as by means of a scorepad and writing instrument, wherein numerical scores can be listed for winners of particular game play sessions.

The controller 24 operates in accordance with instructions and data to facilitate play of the game. The instructions and data may be stored in memory. The controller 24 may include an internal timer that counts to a time interval.

To play a game, button 38 may be depressed to display a question on the screen 14. Buttons 36 and 40 may be used to scroll through different questions. The screen 14 may face one of the players who reads the question or subject. The screen 14 can be rotated to a different player after each round of play. The display of the question also begins a timer. The timer function may be performed by the controller 24. Preferably, the time interval of the timer can vary for each round of play, so that players cannot learn, by past gameplay experience, when a round of play is about to end.

A player can then push a button 16 to answer the question. An indicator 28 can be illuminated for the round to begin, at which time a first person may push their button. The person that pushed their button may be given a time limit to answer the question. For example, the indicator can flash for two seconds. The person with the illuminated indicator is allowed to answer the question. The players continue to push their buttons and provide answers to the question. A player can press their button and call out an answer and then push their button again to call out another answer, without giving time to any other player to push their own button and call out an answer. A player cannot provide the same answer as a previous player, nor can a player provide a same answer twice. This play continues until the time interval of the timer expires. The game may emit a sound through the speaker 32 that indicates the count down of the timer. The sound may vary as the timer approaches the time out value. For example, the speaker may generate a beep, beep, beep sound that increases in frequency as the timer counts the time interval.

Figure 5:
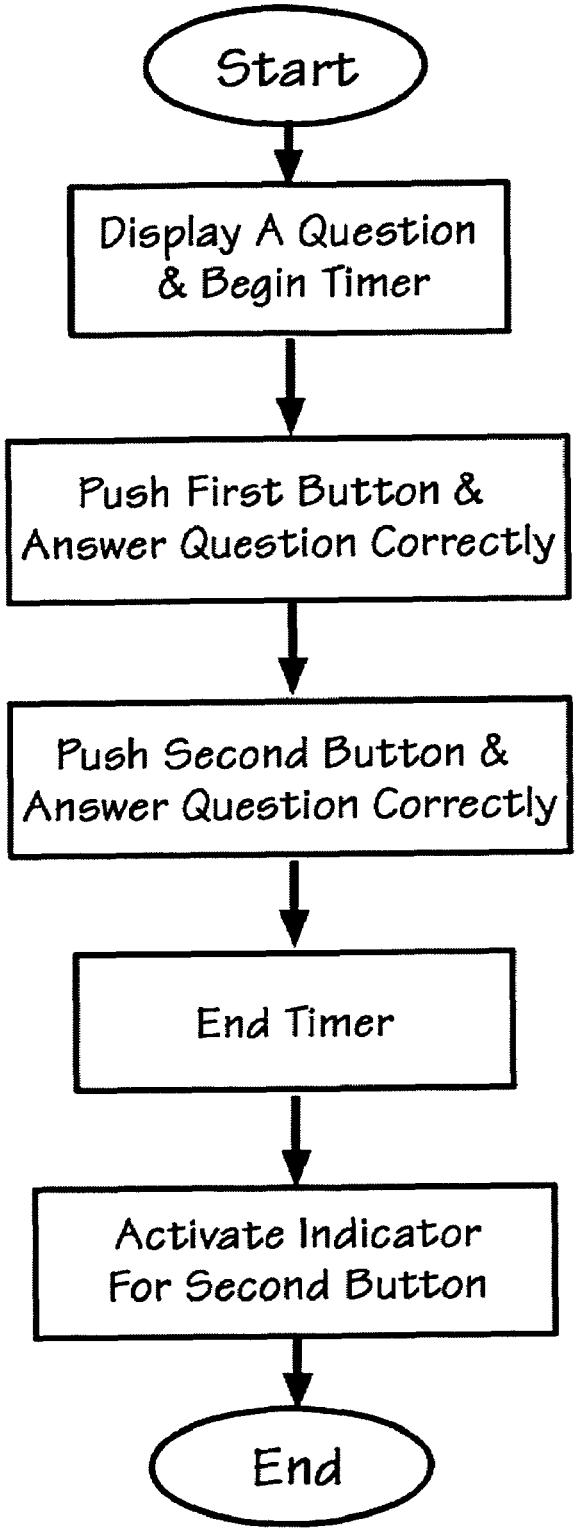
FIG. 5 is a flowchart depicting the game play.

The last player to push their button and provide a correct answer to the question "wins" the round. The controller illuminates the indicator of the person who last pushed their button before the timer expired, and can also illuminate the button of the next to last player to have pressed their button and called out an answer. By way of example, the indicator may rapidly turn on and off. If the last player to push the button did not provide a correct answer then the next to last person to push the button and provide a correct answer may be awarded the round. By way of example, the indicator of the next to last person may have a slow blinking light to differentiate it from the very last person to have pressed their button. The last player to push their button and provide a correct answer to the question "wins" the round. The controller illuminates the indicator of the person who last pushed their button before the timer expired, and can also illuminate the button of the next to last player to have pressed their button and called out an answer. By way of example, the indicator may rapidly turn on and off. If the last player to push the button did not provide a correct answer then the next to last person to push the button and provide a correct answer may be awarded the round. By way of example, the indicator of the next to last person may have a slow blinking light to differentiate it from the very last person to have pressed their button. The game play is shown in the flowchart depicted in FIG. 5.

The person who wins the round can move their token 44 one space on the board 42. The steps of displaying a question, being the last person to correctly answer the question and moving a token can be repeated until one of the players moves their token to the end of the board. The board may include a DOUBLE-IT space 46. If a player moves their token onto a DOUBLE-IT space then on the next round of play, any player who was the last to have answered before the timer ran out can, if they like, attempt to provide a second correct answer to the question, after the completion of the round. A correct answer would allow that player to move two squares on the board, one for the correct answer to win the round, and one for having given a second correct answer. An incorrect second answer would result in that player only moving their token the typical one gameboard space. The board may also have a TEAM PLAY square 48. If a player moves their token into a TEAM PLAY square then that player and another player (perhaps the one to their left or to their right) can both move one gameboard space if either of them win the round.

Figure 3:
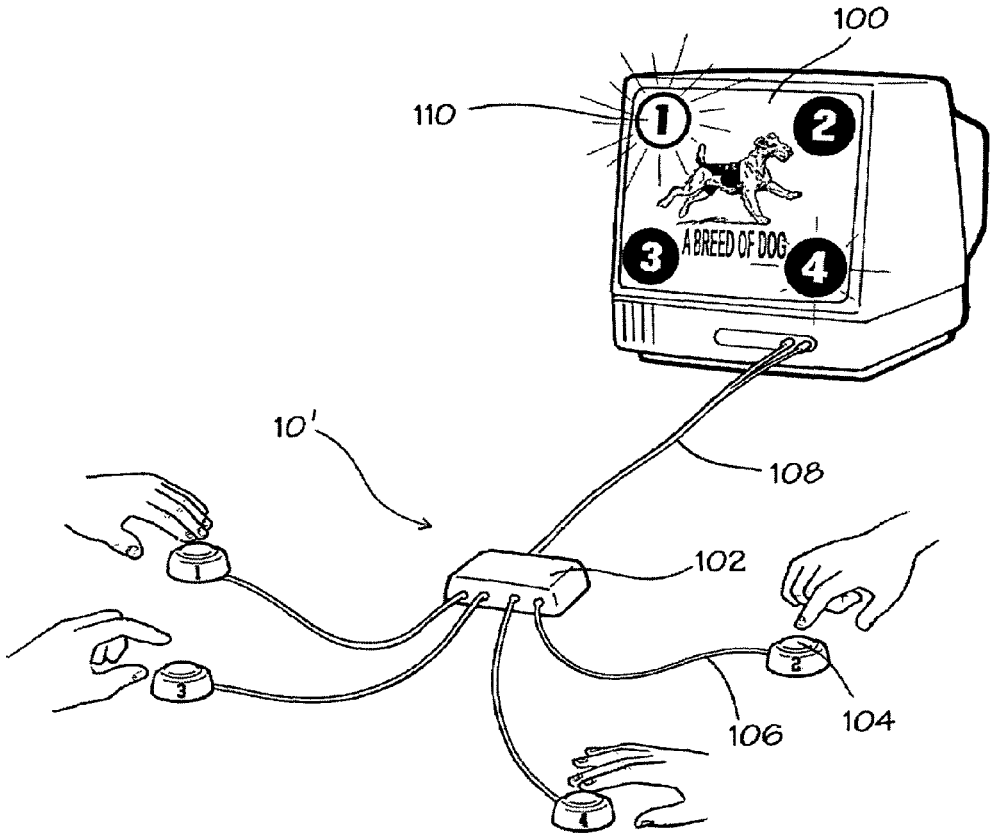
FIG. 3 is an illustration of an alternate embodiment of the electronic game.

FIG. 3 shows an alternate embodiment of a game 10' that can be connected to a television screen 100. The game includes a housing 102 that contains the controller etc. shown and described in the embodiment of FIGS. 1 and 2. The housing 102 is connected to a plurality of buttons 104 by wires 106. The housing 102 is connected to the television 100 by wires 108. The controller within the housing causes a question to be displayed by the television 100. The controller can also cause the display of graphical indicators 110 that are associated with each player.

The game play is similar to that described for the embodiment shown in FIGS. 1 and 2. The graphical indicators 110 may be illuminated for each player that pushes a button, and for the last player and next to last player of a round. The game 10' may also include a board and token (not shown).

Figure 4:
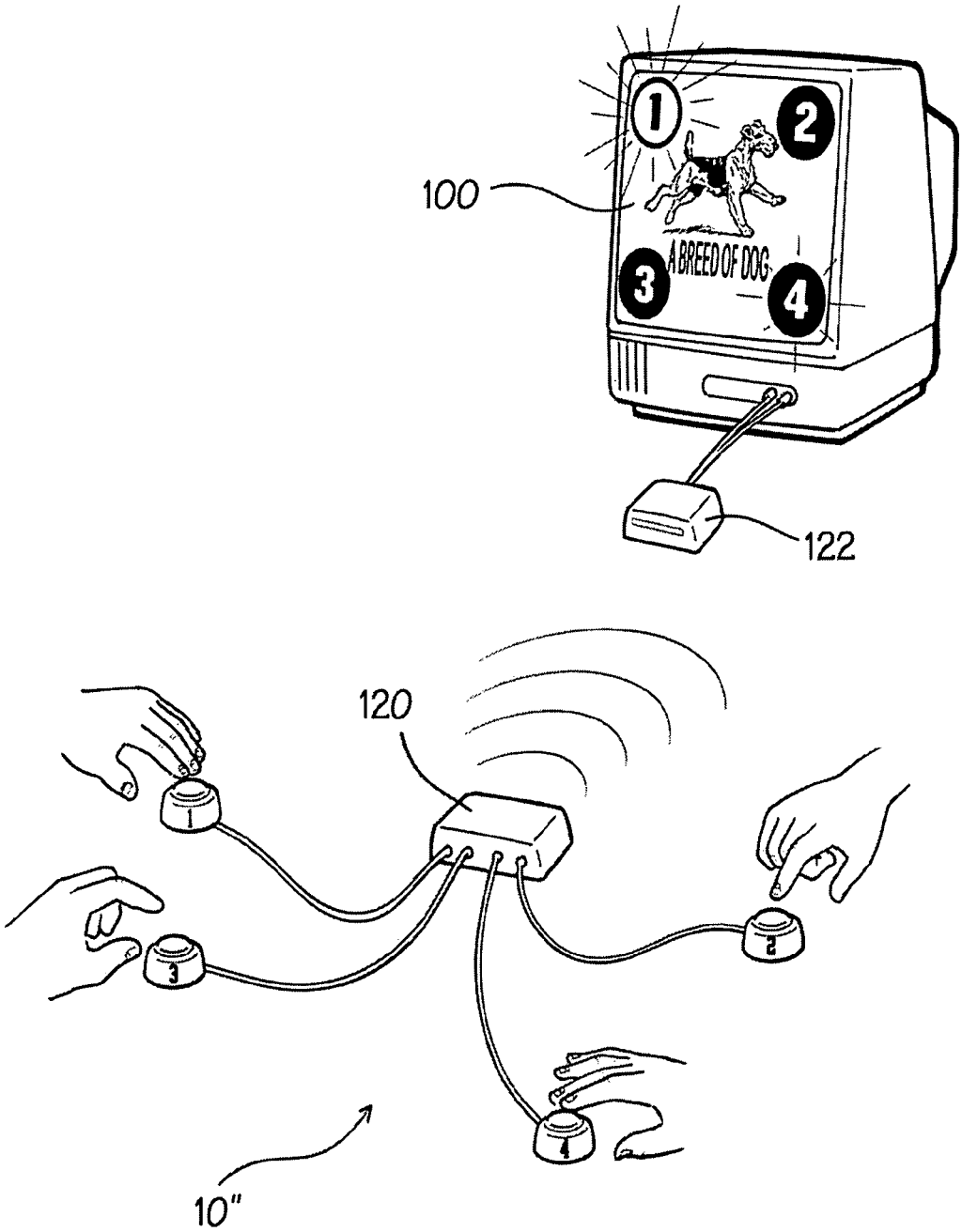
FIG. 4 is an illustration of an alternate embodiment of the electronic game.

FIG. 4 shows yet another embodiment of a game 10" wherein a housing 120 is coupled to the television 100 by a wireless receiver 122, and signals are sent via radio frequency or infrared signaling.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. An electronic game, comprising:

a housing;

a plurality of buttons coupled to said housing;

a plurality of indicators coupled to said housing and associated with said buttons;

a timer that counts a time interval and expires; and, a controller coupled to said buttons, said controller programmed with instructions such that it generates a question, receives a first button input and a subsequent second button input, both indicators of a correct answer to the question, and activates said indicator to indicate that said second button was depressed last by a player that provides a correct answer to the question before an expiration of the time interval, said first and second button inputs occur during said time interval.

2. The game of claim 1, further comprising a screen that displays the questions.

3. The game of claim 1, further comprising a speaker that emits a sound associated with the time interval.

4. The game of claim 1, wherein said controller activates said indicator to indicate that said first button that was depressed by a next to last player that provides a correct answer to the question.

5. The game of claim 2, further comprises a screen that is rotationally coupled to said housing.

6. The game of claim 1, further comprising a game board and a plurality of tokens for each player of the game, one of said tokens being advanced each time said indicator is activated.

7. The game of claim 1, wherein a plurality of questions are generated and said time interval varies for each question.

8. The game of claim 1, further comprising a question button that is coupled to said housing and said controller, said controller varies the question when said question button is depressed.

9. An electronic game that can be coupled to a screen, comprising:

a housing;

a plurality of buttons coupled to said housing;

a timer that counts a time interval; and, question generating means for generating a question, receiving a first button input and a subsequent second input both indicative of a correct answer to the question, and creating an indication for said second button that was depressed last by a player that provides a correct answer to the question before an expiration of the time interval, said first and second button inputs occur during said time interval.

10. The game of claim 9, further comprising a speaker that emits a sound associated with the time interval.

11. The game of claim 9, wherein said question generating means creates an indication to indicate that said first button that was depressed by a next to last player that provides a correct answer to the question.

12. The game of claim 9, further comprising a game board and a plurality of tokens for each player of the game, one of said tokens being advanced each time said indication is created.

13. The game of claim 9, wherein indications are activated each time one of said associated buttons is depressed.

14. The game of claim 9, wherein a plurality of questions are generated and said time interval varies for each question.

15. The game of claim 9, further comprising a question button that is coupled to said housing and said question generating means, said question generating means varies the question displayed by the screen when said question button is depressed.

16. A method for playing a game, comprising:

providing a question;

initiating a timer to count to a time interval;

depressing a first button;

answering the question correctly;

depressing a second button subsequent in time from depression of the first button;

answering the question correctly;

expiring the time interval; and, activating an indicator associated with the second button for a last player that depresses the second button and answers the question correctly before an expiration of the time interval.

17. The method of claim 16, further comprising activating a next to last player's indicator if the last player incorrectly answers the question.

18. The method of claim 16, further comprising advancing a token on a game board.

19. The method of claim 16, further comprising providing an audio indication of the counter counting the time interval.

20. The method of claim 16, further comprising moving a player's token two spaces on the game board when a last player depresses the button and answers the question correctly before the expiration of the time interval.

21. The method of claim 16, wherein the time interval varies for each question.

22. The game of claim 9, wherein said question generating means includes a screen that displays the question.

* * * * *